US007643645B2

(12) United States Patent
Richards

(10) Patent No.: US 7,643,645 B2
(45) Date of Patent: Jan. 5, 2010

(54) VEHICULAR PACKAGING SYSTEM FOR HEADPHONE DEVICES

(75) Inventor: Kelly G. Richards, Lapeer, MI (US)

(73) Assignee: Chrysler Group LLC, Auburn Hills, MI (US)

( * ) Notice: Subject to any disclaimer, the term of this patent is extended or adjusted under 35 U.S.C. 154(b) by 805 days.

(21) Appl. No.: 11/177,801

(22) Filed: Jul. 8, 2005

(65) Prior Publication Data

US 2007/0025577 A1 Feb. 1, 2007

(51) Int. Cl.
*H04R 25/00* (2006.01)

(52) U.S. Cl. ..... 381/385; 381/86; 381/374

(58) Field of Classification Search ..... 381/370, 381/374, 376, 302, 86, 389, 377, 378, 385; 297/188.01, 188.04, 217.3, 217.4, 391; 455/575.2
See application file for complete search history.

(56) References Cited

U.S. PATENT DOCUMENTS

| | | | | |
|---|---|---|---|---|
| 2,629,023 | A * | 2/1953 | La Fitte | 381/151 |
| 5,775,771 | A * | 7/1998 | La Cour et al. | 297/238 |
| 7,188,896 | B2 * | 3/2007 | Embach | 297/217.4 |
| 2004/0204209 | A1 | 10/2004 | Bosch | |

* cited by examiner

*Primary Examiner*—Huyen D Le
(74) *Attorney, Agent, or Firm*—Ralph E. Smith

(57) ABSTRACT

A vehicular interior packaging system includes a holder for the stowage and ready access of an audio headset. The holder is provided on a headrest of the vehicle, and has an arcuate recess which provides a stowage cradle seat for the headset.

15 Claims, 2 Drawing Sheets

VEHICULAR PACKAGING SYSTEM FOR HEADPHONE DEVICES

FIELD OF THE INVENTION

This invention relates generally to packaging systems for the storage and ready access of audio/speaker headphone devices, for use in connection with a wide variety of seating such as computer chairs, pilot seats, recliner/lounge seating, etc., and more particularly to vehicular seating.

BACKGROUND OF THE INVENTION

Many vehicles come equipped with one or more sets of headphones, hereinafter referred to as headsets or audio headsets. Audio headsets have speakers that cover each ear and are attached to a band that passes over or behind the head. Headsets provide personal listening pleasure and enable the driver to tune in perhaps a radio station while others in the vehicle are enjoying a movie or reading. Headsets tend to be bulky and in general take up a large amount of space. Vehicular storage is at a premium when traveling. Appropriate storage space is often lacking.

A typical method for storing headsets is to lay them on a seat of the vehicle. However, this method limits space usually occupied by passengers and also presents the risk of damage to the headset by someone sitting on it or placing something on top of it. Another storage solution is to put the headset under a seat or on the floor of the vehicle. Unfortunately, this solution leaves the vehicle occupant searching for the headset which often shifts about during travel. Also, and more importantly, the headset may be stepped on. Headsets are not only bulky but they are fragile and often will break when stepped on, sat on, or when seats are adjusted over them.

What is needed is a system for storing headsets which places them out of the way, and yet enables the headsets to be conveniently retrieved when the need arises.

SUMMARY OF THE INVENTION

In accordance with the present invention, a vehicular headrest is designed to allow for suitable headset storage so that the passenger or driver will have an esthetically pleasing, yet convenient way of utilizing and storing headsets. Owner dissatisfaction and warranty claims will be reduced because the risk of a damaged headset due to improper storage will be avoided. Overall vehicle and brand quality will be raised with this improvement feature.

Further in accordance with the invention, a vehicular seat back headrest is provided with a headset holder. The headset is of a type having an elongated arcuate band and an earphone at each end of the band. The headset holder comprises an elongated arcuate recess adapted to receive the band and the earphones to provide a stowage cradle seat for the headset. More specifically, the arcuate recess includes an elongated external channel adapted to receive the band, with external depressions at opposite ends of the channel adapted to receive the earphones when the band is placed in the channel.

Preferably the band is flexibly resilient and is sufficiently stressed when placed on the headrest so that it will clip into the stowage portion of the headrest and resist unintentional separation. A retainer may also be provided for retaining the headset seated on the stowage cradle seat.

One object of this invention is to provide a packaging system for the stowage of a vehicular headset having one or more of the foregoing features and capabilities.

Further areas of applicability of the present invention will become apparent from the detailed description provided hereinafter. It should be understood that the detailed description and specific examples, while indicating preferred embodiments of the invention, are intended for purposes of illustration only and are not intended to limit the scope of the invention.

BRIEF DESCRIPTION OF THE DRAWINGS

The present invention will become more fully understood from the detailed description and accompanying drawings, wherein.

DETAILED DESCRIPTION OF PREFERRED EMBODIMENTS

Figure 1:
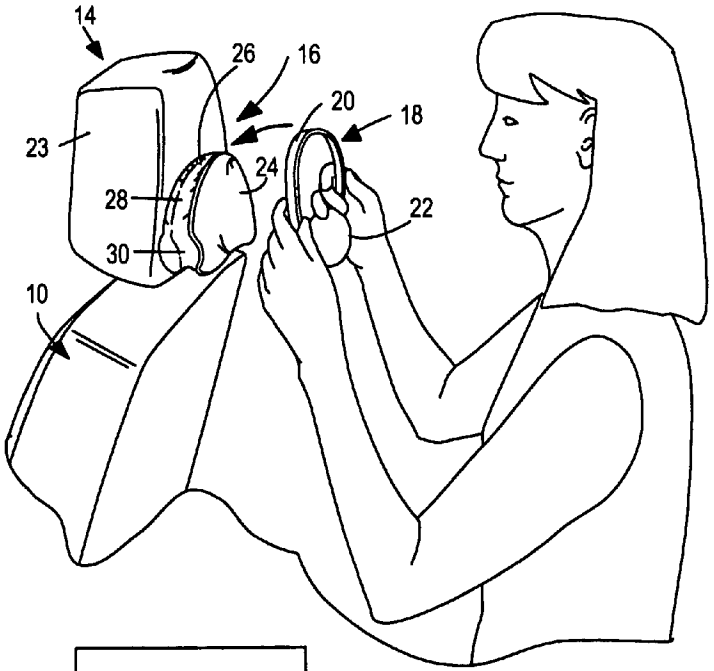
FIG. 1 is a partial perspective view showing a packaging system for practical storage and ready access of a headset, and also showing a person in the process of applying a headset to a headrest.
Figure 2:
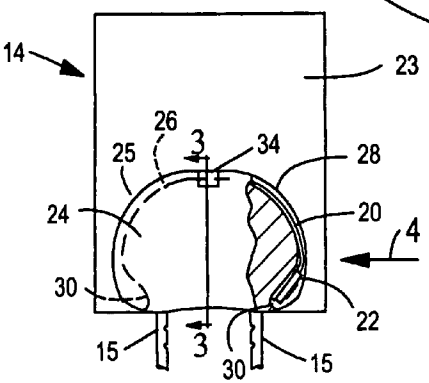
FIG. 2 is an elevational view of the headrest as seen from the rear, with parts in section and with the headset seated on the headrest.

The following description of the preferred embodiments is merely exemplary in nature and is in no way intended to limit the invention, its application, or uses.

Referring now more particularly to the drawings, and especially FIGS. 1-4, there is shown a seat back 10 of a front or rear seat of a vehicle. A headrest 14 is mounted on the top of the seat back 10 by anchor posts 15. Associated with the headrest 14 is a vehicular interior packaging system 16 for the stowage and ready access of an audio headset 18.

The headset 18 includes an elongated arcuate band 20 and an earphone 22 secured to each end of the band. The earphones may vary in shape but are shown as generally circular and disc-like.

The headset 18 is shown in FIG. 1 in the hands of a person in process of placing the headset into a stowed position on the headrest.

The headrest 14 has a main body portion 23 to be contacted by a passenger's head, and a rearward extension 24 which is integral and of one-piece with the main body portion. The packaging system 16 is on the extension 24 and has a headset holder 25 comprising a stowage portion of the extension having an elongated external arcuate recess 26 across the top, extending from side-to-side to provide a stowage cradle seat for the headset. The recess 26 includes an elongated external arcuate channel 28, of inverted generally U-shape, in substantially the same shape and length as the band 20 of the headset. The recess 26 also includes an external depression 30 and opposite ends of the channel, which corresponds in shape to the earphones 22. When the headset 14 is stowed, the band 20 is received in the channel 28 and the earphones are received in the depressions 30. The recess is substantially open and visible from end-to-end to enable ready access for the stowing and removal of the headset. The rear surface of the main body portion 23 of the headrest above the extension 24 provides a back stop to facilitate the installation of the headset 14 in the recess 26.

The band 20 of the headset is flexible and resilient and made of any suitable material such as spring steel. The arc of the band in its natural, free state or unflexed condition is somewhat smaller than the arc of the channel 28 so that when the band is placed in the channel 28, the band is flexed and expanded and placed under stress, causing the headset to resiliently clip into a stowed position in the recess and resist unintentional separation.

Figure 3:
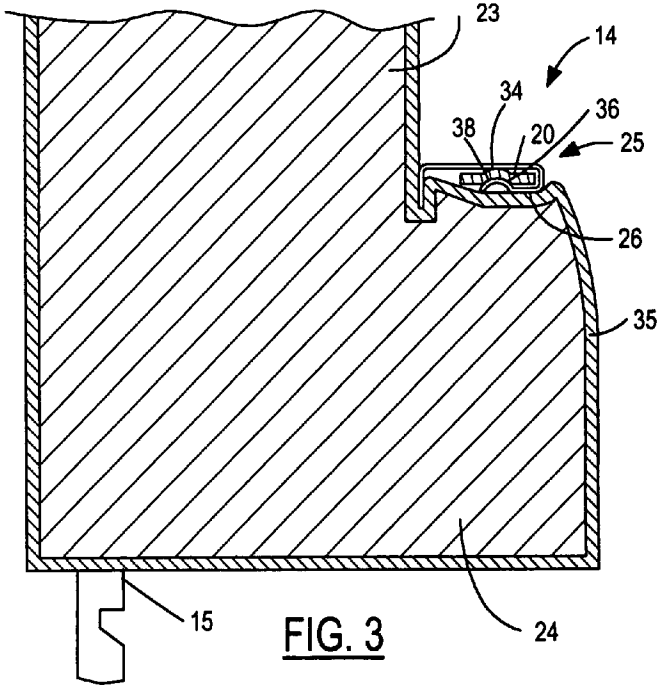
FIG. 3 is a sectional view taken on the line 3-3 in FIG. 2.
Figure 4:
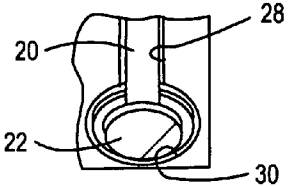
FIG. 4 is a partial view taken in the direction of the arrow 4 in FIG. 2.
Figure 5:
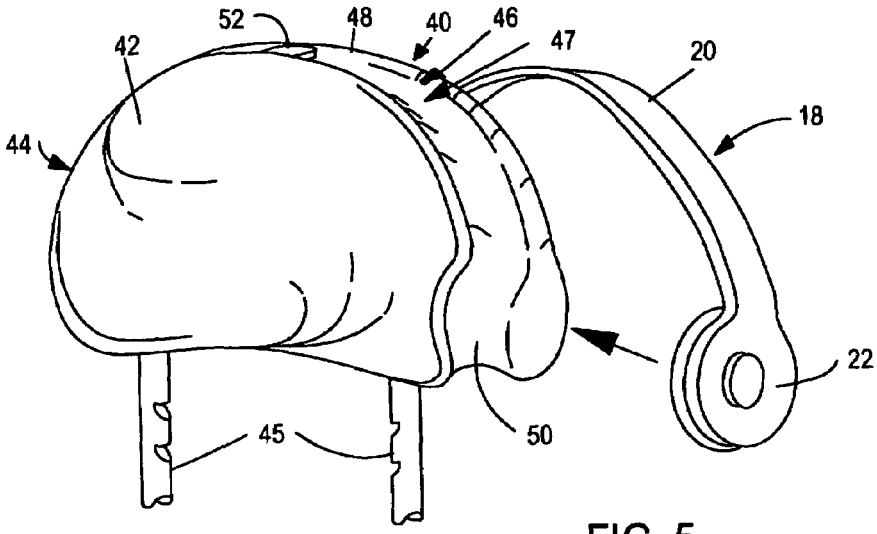
FIG. 5 shows a modification of the invention in which a headrest is of a somewhat different configuration but has a portion provided for proper stowage of a headset.
Figure 6:
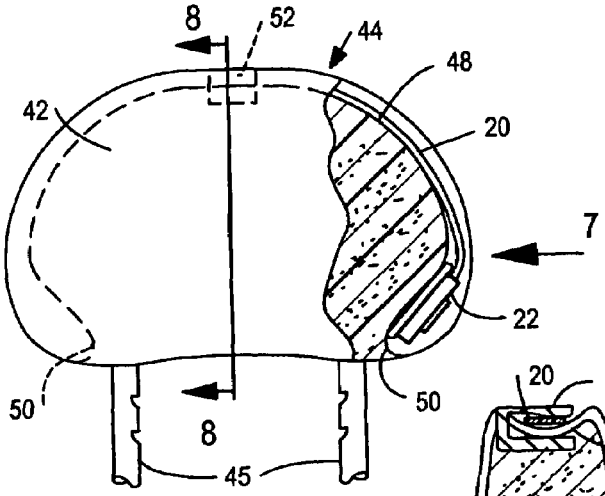
FIG. 6 is an elevational view of the headrest in FIG. 5, with parts in section.
Figure 7:
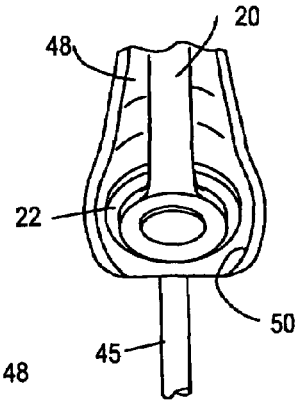
FIG. 7 is a partial side view taken in the direction of arrow 7 in FIG. 6.
Figure 8:
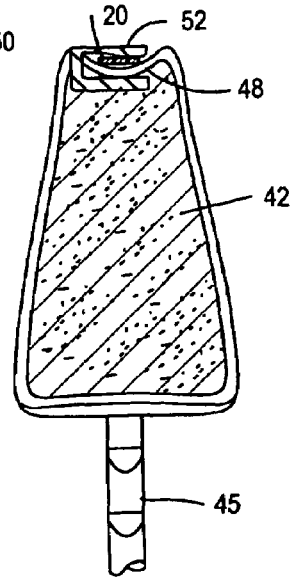
FIG. 8 is a sectional view taken on line 8-8 in FIG. 6.

An optional retainer, preferably in the form of a generally U-shaped clip 34, is mounted on the rearward extension 24 of the headrest 14 to engage over the band 20 of a headset 18 and releasably retain the headset in a stowed position on the stowage seat. As shown in FIG. 3, the clip 34 is insert molded into the seat cover material 35 and has detent bead 36 to engage a recess 38 in the band 20. This optional retainer can be provided to improve the retaining strength of the system.

Referring now to FIGS. 5-8, a modification of the invention is shown in which the interior packaging system 40, similar to the packaging system 16 in the first embodiment, is disposed on the main body portion 42 of a headrest 44, rather than on a rearward extension of the headrest. The headrest 44 is adapted to be mounted on a seat back, such as the seat back 10, by anchor posts 45.

The packaging system 40 has a headset holder 46 comprising a stowage portion of the headrest having an elongated external arcuate recess 47 across the top of the main body portion 42, extending from side to side thereof. The headrest recess 47 includes an elongated external arcuate channel 48, of inverted generally U-shape, in substantially the same shape and length as the band 20 of the headset. The recess 46 also includes external depressions 50 at opposite ends of the channel, which correspond in shape to the headset earphones 22. When the headset 14 is stowed, the band 20 is received in the channel 48 and the earphones are received in the depressions 50. The recess is substantially open and visible from end-to-end to enable ready access for the stowing and removal of the headset.

As in the previous embodiment, the arc of the band 20 of the headset in its natural, free state or unflexed condition is somewhat smaller than the arc of the channel 48 so that when the band is placed in the channel 48, the band is flexed and expanded and placed under stress, causing the headset to resiliently clip into a stowed position in the recess, and resist unintentional separation.

An optional retainer, preferably in the form of a generally U-shaped clip 52, is mounted on the main body portion 42 of the head rest 14 to engage over the band of a headset 18 and releasably retain the headset in a stowed position.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A packaging system for the stowage and ready access of an audio headset having an elongated arcuate band and an earphone at each end of the band, comprising:

a seat back headrest, a headset holder integrally formed of the headrest comprising a stowage portion of the headrest having an elongated arcuate recess formed in an outer surface thereof that is adapted to receive the band and the earphones providing a stowage cradle seat for the headset; and a retainer clip mounted to the headset holder having a rearwardly extending retainer clip leg overlying a portion of the elongated arcuate headset band receiving recess with the headset band receivable between the retainer clip leg and the elongated arcuate headset band receiving recess.

2. A vehicular interior packaging system for the stowage and ready access of an audio headset having an elongated arcuate band and an earphone at each end of the band, comprising:

a vehicular seat back headrest, a headset holder comprising a stow age portion of the headrest having an elongated external arcuate recess including an elongated external arcuate channel, of inverted generally U-shape, adapted to receive the band, the recess also having external depressions at opposite ends of the channel adapted to receive the respective earphones when the band is received in the channel, thereby to provide a stowage seat for the headset, said recess being substantially open and visible from end to end thereof to enable ready access for the stowing and removal of the headset;

wherein said headset band is flexibly resilient and is sufficiently stressed when said band is received in the elongated arcuate headset band receiving channel and the earphones are received in the earphone receiving depressions causing the headset to resiliently clip to the stowage portion and resist unintentional separation therefrom; and a retainer clip molded into the headset holder that cooperates with the elongated arcuate headset band receiving channel in releasably retaining the headset band of a headset therein.

3. The vehicular interior packaging system of claim 2, wherein said headrest has a main body portion and an integral rearward extension of the main body portion, and said elongated arcuate recess formed in an upper external surface of the rearward extension and extending from side-to-side of the rearward extension.

4. The vehicular interior packaging system of claim 3, wherein the rearward extension has a height and width lesser than a height and width of the main body portion.

5. The vehicular interior packaging system of claim 2, further including a retainer for releasably retaining said headset seated on a stowage cradle seat.

6. The vehicular interior packaging system of claim 5, wherein the headrest has an outer covering comprised of a seat covering material and the clip is insert molded into the seat cover material and the retainer comprises a clip having a retainer leg that overlies the headset band channel.

7. The vehicular interior packaging system of claim 6, wherein the clip has a generally rearwardly extending retainer clip leg that generally transversely overlies the headset band receiving channel enabling the band of the headset to be releasably captured between the retainer clip leg and the headset band receiving channel.

8. The vehicular packaging system of claim 2, wherein said arcuate recess is disposed on an upper surface of the headrest.

9. The vehicular packaging system of claim 2, wherein said arcuate recess is disposed on an upper surface of a main body portion of the headrest and extends from side-to-side of the main body portion.

10. A vehicular interior packaging system for the stowage and ready access of an audio headset having an elongated arcuate band and an earphone at each end of the band, comprising:

a vehicular seat back headrest, a headset holder integrally formed of said headrest, said headset holder comprising a stowage portion of the headrest having an elongated external arcuate recess including an elongated external arcuate channel, of inverted generally U-shape, adapted to receive the band, the recess also having external depressions at opposite ends of the channel adapted to receive the respective ear phones when the band is received in the channel, thereby to provide a stowage seat for the headset, said recess being substantially open and visible from end to end thereof to enable ready access for the stowing and removal of the headset; and wherein said headrest has a main body portion and an integral outward and rearward extension of the main body portion, and said arcuate recess is disposed on an upper surface of the rearward extension and extends from side-to-side of the headrest; and wherein the headset holder includes a retainer that comprises a clip that releasably retains said headset when seated on said stowage seat with the clip comprising a detent bead that is engageable in a recess in the band of said headset.

11. The vehicular interior packaging system of claim 10, wherein the main body portion of the headrest has a rear surface above the rearward extension to provide a back stop to facilitate the installation of the headset in the arcuate recess.

12. The vehicular interior packaging system of claim 11, wherein said band is flexibly resilient and is sufficiently stressed when the band is received in the channel and the earphones are received in the depressions to cause said headset to resiliently clip to the stowage portion and resist unintentional separation therefrom.

13. The vehicular interior packaging system of claim 10, wherein the headrest has an outer covering comprised of a seat covering material and the clip is insert molded into the seat covering material.

14. The vehicular interior packaging system of claim 10, wherein the clip has a generally rearwardly extending retainer leg that generally transversely overlies the band channel enabling the band of the headset to be releasably captured between the retainer leg and the headset band channel.

15. The vehicular interior packaging system of claim 10, wherein the rearward extension has a height anti width lesser than a height and width of the main body portion.

* * * * *